United States Patent [19]

Beausoleil et al.

[11] Patent Number: 4,850,289

[45] Date of Patent: Jul. 25, 1989

[54] INCINERATOR

[76] Inventors: Harris Beausoleil, 5040, Chemin du Lac; Gabriel Beausoleil, 5020, Chemin du Lac, both of St. Gabriel, Quebec, Canada, J0K 2N0

[21] Appl. No.: 128,024

[22] Filed: Dec. 3, 1987

[30] Foreign Application Priority Data

Dec. 11, 1986 [GB] United Kingdom ..... 8629689

[51] Int. Cl.[4] ..... B09B 3/00

[52] U.S. Cl. ..... 110/235; 110/102; 110/118; 110/256

[58] Field of Search ..... 110/102, 118, 256, 212, 110/235

[56] References Cited

U.S. PATENT DOCUMENTS

| | | | |
|---|---|---|---|
| 3,855,950 | 12/1974 | Hughes, Jr. et al. | 110/212 X |
| 4,218,980 | 8/1980 | Probsteder | 110/256 X |
| 4,366,802 | 1/1983 | Goodine | 110/118 X |
| 4,531,464 | 7/1985 | Eshleman | 110/102 X |
| 4,559,882 | 12/1985 | Dobson | 110/102 X |

*Primary Examiner*—Edward G. Favors
*Attorney, Agent, or Firm*—Roland L. Morneau

[57] ABSTRACT

The incinerator is made of a loading member, a burning chamber, a combustion chamber and a duct member having a restricted dimension for connecting the burning and the combustion chambers. The loading member is an upstanding cylinder for receiving the waste material and dropping it in the burning chamber. The burning chamber has a floor located at such a distance from loading cylinder so as to obtain the spreading of the waste material in a generally frusto-conical shape. A peripheral wall around the burning chamber is dimensioned to leave an air space around the frusto-conical shape. An air intake in the peripheral wall provides a circulation of air in the air space. The duct members are diametrically opposed to the air intake and funnel the hot fumes from the burning chamber to the combustion chamber. The concentration of the hot fumes in the duct members considerably raises the temperature in the duct members for a practically complete decomposition of the products in the fumes.

7 Claims, 2 Drawing Sheets

INCINERATOR

BACKGROUND OF THE INVENTION

1. Field of the Invention

The present invention relates to an incinerator and in particular to a type capable of producing very high temperature to eliminate practically all pollutants.

2. Prior Art

A search of the prior art has revealed the following patents: U.S. Pat. Nos. 2,548,203, 3,043,246, 3,563,187, 3,777,676 and Canadian Pat. Nos. 80,959, 486,840, 939,198, 1,071,485, 1,131,027. None of this patents are pertinent and relates to a concept and a structure as hereinafter described.

SUMMARY OF THE INVENTION

The incinerator according to the invention comprises an upstanding tubular loading member for receiving waste material, a burning chamber connected to and disposed below the tubular member. The burning chamber comprises a floor and a peripheral wall. The floor is located at such a distance from said tubular member to allow the waste material to drop on the floor and form a truncated cone shape continuous with the tubular member. The size of the peripheral wall allows a peripheral air space around the truncated cone shape. The peripheral wall is provided with an air inlet for supplying air to the air space, with a feeding opening for igniting the waste material and with a tubular duct opposite the air inlet for funnelling out the air from said air space. A combustion chamber is connected to the duct and is provided with a suitable chimney so as to suck the air from the duct after the combustion chamber has been preheated with a burner.

Figure 1:
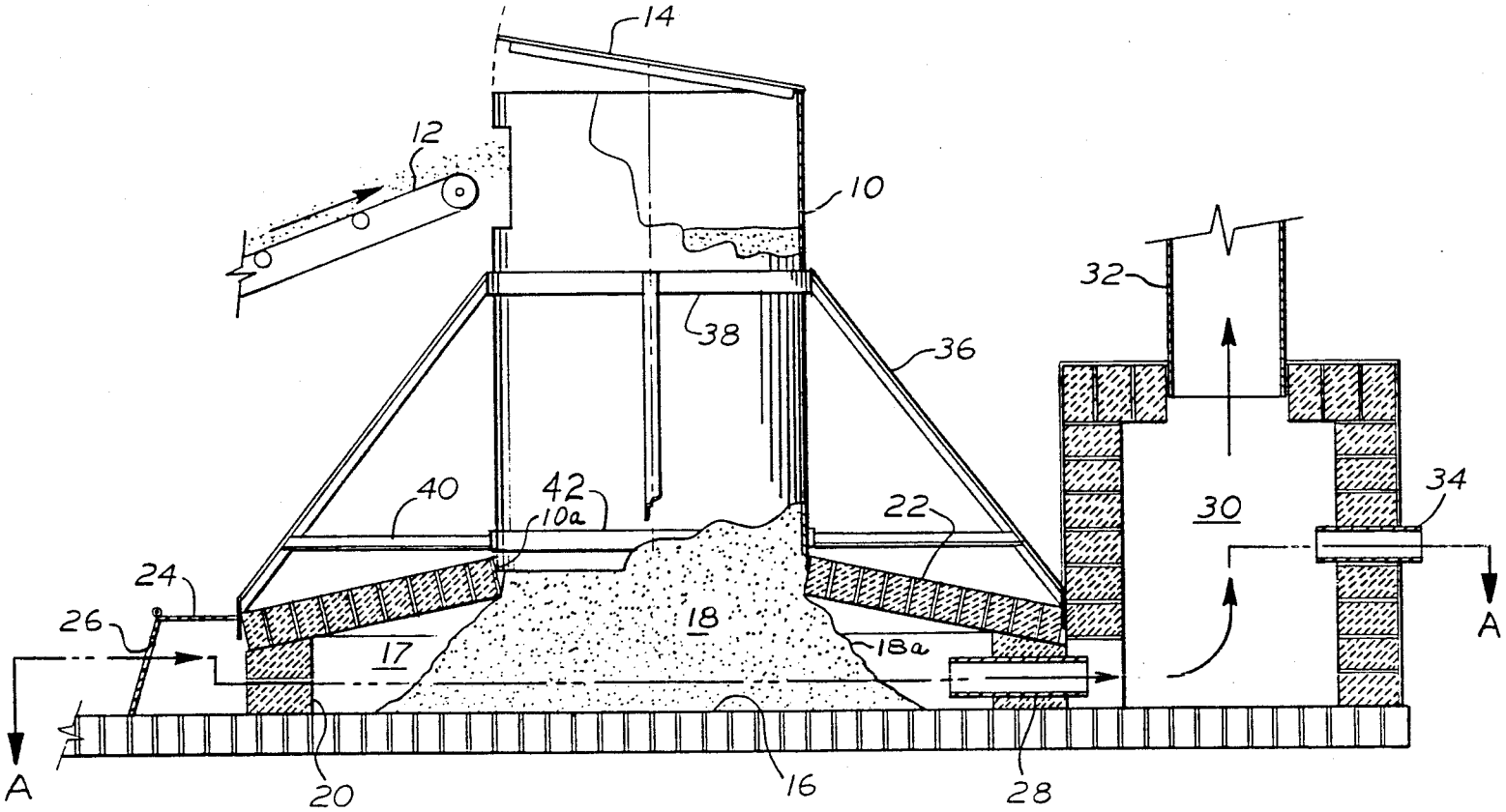
FIG. 1 is a vertical cross-sectional view of an incinerator according to the invention.
Figure 2:
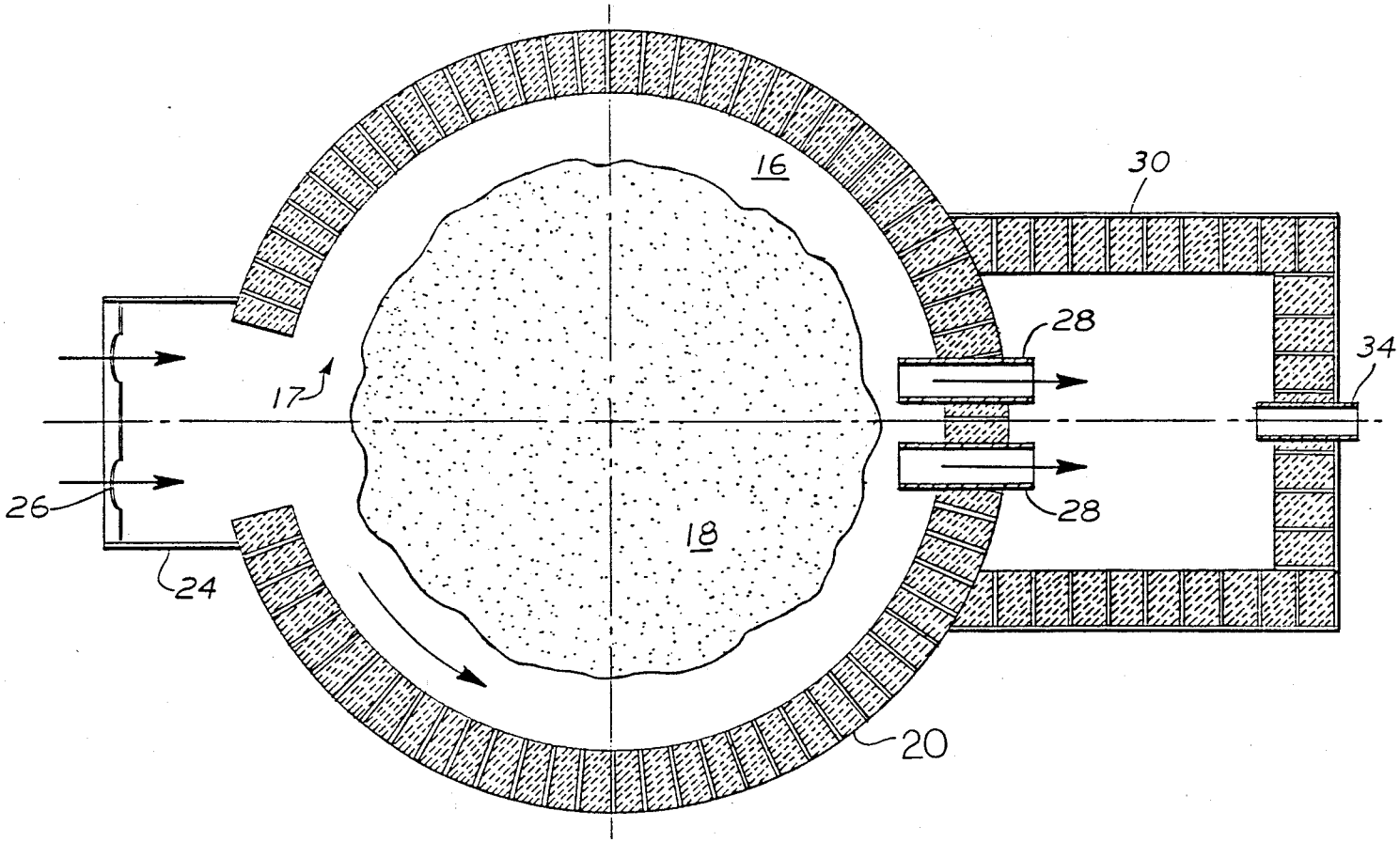
FIG. 2 is a horizontal cross-sectional view taken along line A—A of FIG. 1.

DETAILED DESCRIPTION OF THE INVENTION:

In the incinerator shown in FIG. 1, the waste material is inserted at the top of a cylindrical loading member 10 which is loaded by conveyor 12 bringing the waste material near the top of the cylindrical member 10. A cover 14 is adapted to seal the top of the cylindrical member 12 when the incinerator is in operation. The wast material is dropped directly into the cylindrical member 10 and falls on the floor 16 of the burning chamber 17 of the incinerator. For the purpose of this description, the waste material is saw dust, although any material such as tires, plastic, rugs, garbage which can be at least partly burt may be considered suitable for this kind of incinerator.

When the saw dust 18 reaches the floor 16, it piles up into a generally truncated cone 18*a* between the floor 16 and the base 10a of the cylindrical member 10. The floor 16 is surrounded by a shallow circular peripheral wall 20 having a diameter larger than the base of the truncated cone 18*a*. The roof 22 having the shape of a sloping ring closes the gap between the top of the peripheral wall 20 and the base 10*a* of the cylindrical member 10. The peripheral wall 20 has a feeding channel 24 for igniting the waste material at the periphery of the truncated cone 18*a*. The opening 26 of the feeding channel

24 is also used for removing the material which cannot be burnt or when cleaning is required. The opening 26 of the feeding channel 24 may be provided with adjustable air intakes for providing the necessary oxygeous atmosphere, for allowing the ignition to take place and for maintaining an air flow around the truncated cone 18*a*. The circulation of constant fresh air accelerate the flame and the burning of the waste material in the truncated cone 18*a*.

The large volume of air circulation in the burning chamber 17 around the truncated cone 18*a* is funneled out through restricted outlets formed by tubular channel members 28 which concentrate the heat produced by the incandescent waste material in the truncated cone 18*a*. The number and the size of channel members 28 vary depending on the volume of the burning chamber 17, the size of the surface of the floor 16 and the flow of air which enter through the air intakes 26 combimed with the volume of air which can circulate around the truncated cone 18*a*.

At the exit of the channel members 28, a combustion chamber 30 is built for receiving the burning gas which have reached a very high temperature when the heat was concentrated by the channel members 28. A chimney 32 projects over the combustion chamber 30 for sucking and eliminating the heat and the remaining gas. The combustion chamber 30 is fed by a gas burner (not shown) through the inlet 34 for pre-heating the combustion chamber 30 to about 800° F. to 1200° F.

In actual operation, the first step in starting the incinerator consists in heating up the combustion chamber 30 with the gas burner through the inlet 34 at a temperature as mentioned above. This procedure takes at least 10 to 15 minutes. The heating of the combustion chamber 30 is intended to produce a sucking effect in the channel members 28 and for facilitating the ejection by the chimney 32. When the desired temperature has been reached in the combustion chamber 30, a fire in initialed and built up through the feeding channel 24. Assuming that saw dust 18 has been introduced in the cylindrical member 10 and has formed a truncated cone 18*a*, dried pieces of wood are introduced in the feeding channel 24 and ignited. The fire propagates to the saw dust in 18*a* while the air coming from the air intakes 26 circulates around the truncated cones 18*a*. This circulation is accelerated by the air sucked through the channel members 28 and by the fresh air which keeps coming through the air intakes 26 to replaces the one exhausted.

As the temperature keeps increasing, around the cone 18*a*, the temperatue in the channel chamber 28 is considerably raised because the heat from a large volume around the cone 18*a* is concentrated through the comparatively small area of the channel chamber 28. The channel chamber 28 is thus brought to white heat. At such temperature which is about 2000° F. to 3000° F., all combustible waste material which has not been burnt on the floor 16 is practically completely destroyed and reduced to ashes and gas. The fumes including pollutant gas which passes the chamber 28 are also considerably desintegrated. The desintegration of the gas is pursued in the combustion chamber 30 before a substantially pollutant free gas is exhausted by the chimney 32.

The incinerator roof 16 and wall 20, the ring 22 and the combustion chamber 30 are made of a refractory lining such as fire-proof bricks. The channel chamber 28 is made of refractory linings such as steel and ceramics which are fire-proof suitable to stand a temperature of about 3000° F.

In order to accelerate the burning of the waste material in the cone 18*a*, it has been contemplated to warm up the content of the cylindrical member 10. For this purpose, a conical steel frame 36 forming a skirt is mounted around the cylindrical member 10, the base of the frame 36 being located over and around the ring-shaped roof 22. The frame 36 is supported by a circular brace 38 tightened around the upper part of the cylindrical member 10 and by radial beams 40 extending between the lower end of the cylindrical chamber 10 and a brace 42 secured around the conical frame 36. With this arrangment, the conical frame 36, the beams 40 and the braces 42 put no weight on the ring-shaped roof 22.

The heat which is generated by the roof 22 is held against the surface of the cylindrical member 10 and help to dry up the waste material 18 which supplies the truncated cone 18*a*. Once the material 18 is partly dryed up, the burning of the same material reaching the truncated cone 18*a* is that much accelerated and thorough.

The top of the cylindrical member 10 is provided with a sealed cover 14 for preventing the upward movement of the air and gas and the propagation of the fire upwardly into the column of material 18. However, a conveyor 12 for the waste material is foreseen for reaching the upper level of the cylindrical member 10. Such conveyor 12 is designed to feed the material at a rate sufficient to maintain the level of the material in the member 10. The conveyor is also provided with commonly known flap valves or the like for the same reasons as stated for the utility of the cover 14. The air intakes 26 vary in number or in size depending the flow of air which needs to be supplied. The use of fans has also been made to increase the flow of air when the size and the number of intakes must not occupy a too wide portion of the peripheral wall 20.

It is within the embodiment to install more than one channel members 28. The number is determined by the volume of the interior of the incinerator and the flow of air coming through the air intakes 26. The number of channel members 28 is also determined by the temperature at which these latter members needs to be raised to provide the desired reduction to ashes i.e. until it is white-heated. The air intakes 26 have a variable total diameter and this range of diameters encompass the total diameter of the channels 28. It is possible to control the intensity of the fire by varying the diameter of the air intakes 26 or by accelerating the flow of air with fans located in the air intakes.

In a specific embodiment using saw dust, the incinerator has the following dimensions:

| | |
|---|---|
| Diameter of the cylindrical member 10: | 30½ in. |
| Height of the cylindrical member 10: | 4½ feet. |
| External diameter of the floor 16: | 7 feet |
| Height of the peripheral wall 20: | 10 in. |
| Height of the bricks of the roof 22: | 6 in. |
| Height of the truncated cone 18a: | 15 in. |
| Width of the feeding channel 24: | 2 feet |
| Diameter of air intakes (variable): | 3½ in. |
| Diameter of air intakes with fan: | 6 in. |
| Height of the combustion chamber 30: | 30 in. |
| Area of the combustion chamber 30: | 30 in. × 30 in. |
| Height of the chimney: | about 15 feet |
| Diameter of the chimney: | 12 in. |
| Diameter of the channel members 28: | 4 to 18 in. |
| Length of the channel members 28: | 6 to 18 in. |

We claim:

1. An incinerator comprising an upstanding tubular loading member for receiving waste material, the said tubular member having a cover for tightly closing the upper end of said tubular member, a substantially cylindrical burning chamber connected to and disposed coaxially below said loading member. said burning chamber comprising a floor and a peripheral wall, said floor being at a distance from said tubular member to allow the waste material to fall by gravity on said floor and to freely spread into a generally truncated cone-shape, the apex of said cone-shape being continuous with the waste material in said tubular member, the peripheral wall of the burning chamber being shallow and of a diameter to leave a peripheral air space around said truncated cone-shape, an air intake in the peripheral wall of said burning chamber for the introduction of air in said air space, a feeding channel along the peripheral wall of said burning chamber for igniting said waste material, a tubular duct in the periphery of said burning chamber opposite said air intake for funnelling out the heated air from said air space, the said duct having a restricted diameter for concentrating the heat produced in the burning chamber, the said duct being adapted to be brought to white heat, a combustion chamber connected to said duct for receiving the heated air ejected from said duct, a chimney mounted on said combustion chamber, the said chimney being of a size and height adapted to suck air from said combustion chamber, means connected to said combustion chamber for preheating the latter, whereby the burning of the ignited waste material is activated by the flow of air circulating around said material in the truncated cone-shape, the said flow of air being accelerated by the suction of said chimney through said duct.

2. An incinerator as recited in claim 1 comprising an enclosed drying chamber mounted over the said burning chamber around said tubular member, whereby the heat radiated upwardly by said burning chamber is maintained around the periphery of said tubular member.

3. An incinerator as recited in claim 2 whereby the said drying chamber comprises a frusto-conical peripheral skirt supported by said tubular member.

4. An incinerator comprising an upstanding tubular loading member for receiving waste material, the said tubular member having a cover for tightly closing the upper end of said tubular member, a burning chamber connected to and disposed below said loading member, the said burning chamber comprising a floor and a peripheral wall, the said floor being at a distance from said tubular member to allow the waste material to form by gravity, a generally truncated cone-shape continuous with the waste material in said tubular member, the peripheral wall of the said burning chamber being of a size to leave a peripheral air space around the said truncated cone-shape, an air intake in the peripheral wall of said burning chamber for the introduction of air in said air space, a feeding channel along the peripheral wall of said burning chamber for igniting said waste material, a tubular duct in the periphery of said burning chamber opposite said air intake for funnelling out the air from said air space, a combustion chamber connected to said duct for receiving the air ejected from said duct, a chimney mounted on said combustion chamber, the said chimney being of a size and height adapted to suck air from said combustion chamber, means connected to said combustion chamber for pre-heating the latter an enclosed drying chamber mounted over said burning chamber around said tubular member, whereby the burning of the ignited waste material is activated by the flow of air surrounding the said material in the truncated cone-shape, the said flow of air being accelerated by the suction of said chimney through said duct the heat radiated upwardly by said burning chamber is maintained around the periphery of said tubular member.

5. An incinerator as recited in claim 4 whereby said peripheral wall is shallow and substantially circular.

6. An incinerator as recited in claim 3 or 1 comprising a ring-shaped roof over said burning chamber, the said roof being slightly inclined downwardly towards the peripheral wall of the burning chamber.

7. An incinerator as recited in claim 4 wherein the air intake comprises means for varying the flow of air.

* * * * *